US007034471B2

(12) United States Patent
Kimura et al.

(10) Patent No.: US 7,034,471 B2
(45) Date of Patent: Apr. 25, 2006

(54) COLD-CATHODE TUBE OPERATING APPARATUS

(75) Inventors: Kengo Kimura, Niiza (JP); Tooru Ashikaga, Niiza (JP)

(73) Assignee: Sanken Electric Co., Ltd., Saitama (JP)

( * ) Notice: Subject to any disclaimer, the term of this patent is extended or adjusted under 35 U.S.C. 154(b) by 5 days.

(21) Appl. No.: 10/508,472

(22) PCT Filed: Mar. 17, 2003

(86) PCT No.: PCT/JP03/03137

§ 371 (c)(1),
(2), (4) Date: Sep. 21, 2004

(87) PCT Pub. No.: WO03/081963

PCT Pub. Date: Oct. 2, 2003

(65) Prior Publication Data

US 2005/0088115 A1 Apr. 28, 2005

(30) Foreign Application Priority Data

Mar. 27, 2002 (JP) ..... 2002-087956

(51) Int. Cl.
*G05F 1/00* (2006.01)
*H05B 37/02* (2006.01)

(52) U.S. Cl. ..... 315/308; 315/360; 315/287

(58) Field of Classification Search ..... 315/227 R, 315/244, 276, 283, 287, 291, 307–308, 360; G05F 1/00; H05B 37/02
See application file for complete search history.

(56) References Cited

U.S. PATENT DOCUMENTS

| | | | | |
|---|---|---|---|---|
| 5,705,877 | A * | 1/1998 | Shimada | 310/318 |
| 5,754,012 | A * | 5/1998 | LoCascio et al. | 315/307 |
| 5,859,489 | A * | 1/1999 | Shimada | 310/318 |
| 6,013,969 | A * | 1/2000 | Noma et al. | 310/318 |
| 6,151,232 | A | 11/2000 | Furuhashi et al. | 363/97 |
| 6,198,198 | B1 * | 3/2001 | Fujimura et al. | 310/316.01 |
| 6,259,615 | B1 | 7/2001 | Lin | 363/98 |

FOREIGN PATENT DOCUMENTS

EP 0 910 229 A2 4/1999

(Continued)

*Primary Examiner*—Thuy Vinh Tran
(74) *Attorney, Agent, or Firm*—Brenda O. Holmes; Kilpatrick Stockton LLP

(57) ABSTRACT

The present invention can provide a cold cathode tube lighting apparatus capable of causing no pulsating current, intermittent oscillation, or flicker-off even under light load, stably keeping a cold cathode tube lighting, safely tuning on the same, and the like. The present invention is characterized by supplying a rectangular wave voltage Vs to a series resonance circuit 12 and by driving the cold cathode tube 8 with an output of the series resonance circuit. The series resonance circuit has a constant that makes a maximum output voltage with respect to a predetermined tube current value exceed a tube voltage $V_L$ of the cold cathode tube when the cold cathode tube is turned on and in an operating load range of the cold cathode tube of negative resistance characteristic. A control circuit 15 controls a cold cathode tube current $I_L$ to a predetermined value while the cold cathode tube is in a lit state. At black start of the cold cathode tube, the control circuit prevents a tube voltage of the cold cathode tube from exceeding a predetermined voltage until the cold cathode tube is turned on.

7 Claims, 8 Drawing Sheets

FOREIGN PATENT DOCUMENTS

| | | |
|---|---|---|
| JP | 2000-331787 | 11/2000 |
| JP | 2002-15881 | 1/2002 |
| JP | 3084310 | 3/2002 |
| WO | WO 99/08373 | 2/1999 |

* cited by examiner

COLD-CATHODE TUBE OPERATING APPARATUS

This application is a 371 application (National Stage entry) of international patent application No. PCT/JP03/03137 filed on Mar. 17, 2003, which claims foreign priority to JP-2002-087956 filed on Mar. 27, 2002.

TECHNICAL FIELD

The present invention relates to a cold cathode tube lighting apparatus, and particularly, to a cold cathode tube lighting apparatus with a series resonance circuit for lighting a cold cathode tube.

BACKGROUND TECHNOLOGY

A conventional cold cathode tube lighting apparatus 50 shown in FIG. 1 typically consists of a chopper circuit 51 to control a cold cathode tube current $I_L$ to a predetermined value, a parallel resonance circuit 52 composed of a transformer and a capacitor, a ballast capacitor C5 to stabilize discharge, a tube current sensing circuit 14, and a control circuit 53 to control a power supply period for the chopper circuit 51.

To reduce the size of the transformer as small as possible, a turn ratio n thereof is set to $n=\{V_{(STRIKE)}\}/(2\pi V_{IN(DC)}$, where $V_{(STRIKE)}$ (see FIG. 2) is a lighting start voltage of a cold cathode tube 8. It is usual to set a maximum output voltage of the secondary side of the transformer to $V_{(STRIKE)}$.

DISCLOSURE OF INVENTION

When the conventional apparatus 50 turns on the cold cathode tube 8, the ballast capacitor C5 bears a voltage of $I_L/(j\cdot\omega\cdot Cb)$ with respect to a cold cathode tube current $I_L$. Accordingly, a secondary output voltage $V'^{\infty}=\{(I_L/(j\cdot\omega\cdot Cb))^2+(I_L\cdot R_L)^2\}^{1/2}$ of the voltage necessary for maintaining discharge under light load exceeds the maximum output voltage $V_{(STRIKE)}$ that transformer can actually provide from the secondary side thereof. This results in causing a pulsating current, intermittent oscillation, or flicker-off, to destabilize a lit state of the cold cathode tube 8.

The present invention has been made in consideration of the above-mentioned problem and provides a cold cathode tube lighting apparatus capable of causing no pulsating current, intermittent oscillation, or flicker-off even under light load, stably keeping a cold cathode tube lighting, and safely tuning on the same.

The present invention also provides a cold cathode tube lighting apparatus having no risk of badly affecting peripheral devices when a cold cathode tube is detached.

The present invention also provides a cold cathode tube lighting apparatus capable of stably keeping a cold cathode tube lighting even with a low source voltage.

The present invention also provides a cold cathode tube lighting apparatus capable of keeping a cold cathode tube lighting with a power source being in a highly efficient state.

According to a first technical aspect of the present invention to solve the above-mentioned problem, there is provided a cold cathode tube lighting apparatus having a rectangular wave voltage generating circuit to generate a rectangular wave voltage from a direct current input voltage, a series resonance circuit having a resonance inductance, a first resonance capacitor, a cold cathode tube of negative resistance characteristic, and a constant, to convert the rectangular wave voltage into a sine wave voltage, the constant being set to make a maximum output voltage for a predetermined tube current value exceed a tube voltage of the cold cathode tube at the start of lighting the cold cathode tube and in an operating load range of the cold cathode tube of negative resistance characteristic, a cold cathode tube voltage sensing circuit, a cold cathode tube current sensing circuit, and a control circuit to control a cold cathode tube current to a predetermined value according to an output of the cold cathode tube current sensing circuit while the cold cathode tube is in a lit state and prevent a cold cathode tube voltage from exceeding a predetermined voltage according to an output of the cold cathode tube voltage sensing circuit until the cold cathode tube is lit when the cold cathode tube is black-started.

According to a second technical aspect of the present invention to solve the above-mentioned problem, the control circuit in the cold cathode tube lighting apparatus prevents, if the cold cathode tube is detached, a cold cathode tube voltage from exceeding a predetermined voltage and stops the operation of the rectangular wave generating circuit after a predetermined time.

According to a third technical aspect of the present invention to solve the above-mentioned problem, the series resonance circuit in the cold cathode tube lighting apparatus is additionally provided with a step-up transformer.

According to a fourth technical aspect of the present invention to solve the above-mentioned problem, there is provided a cold cathode tube lighting apparatus having a rectangular wave voltage generating circuit to generate a rectangular wave voltage from a direct current input voltage, a series resonance circuit having a resonance inductance, a first resonance capacitor, a second resonance capacitor, a cold cathode tube of negative resistance characteristic, and a constant, to convert the rectangular wave voltage into a sine wave voltage, the constant being set to make a maximum output voltage for a predetermined tube current value exceed a tube voltage of the cold cathode tube at the start of lighting the cold cathode tube and in an operating load range of the cold cathode tube of negative resistance characteristic, a cold cathode tube voltage sensing circuit, a cold cathode tube current sensing circuit, and a control circuit to control a cold cathode tube current to a predetermined value according to an output of the cold cathode tube current sensing circuit while the cold cathode tube is in a lit state and prevent a cold cathode tube voltage from exceeding a predetermined voltage according to an output of the cold cathode tube voltage sensing circuit until the cold cathode tube is lit when the cold cathode tube is black-started.

According to a fifth technical aspect of the present invention to solve the above-mentioned problem, the control circuit in the cold cathode tube lighting apparatus prevents, if the cold cathode tube is detached, a cold cathode tube voltage from exceeding a predetermined voltage and stops the operation of the rectangular wave generating circuit after a predetermined time.

According to a sixth technical aspect of the present invention to solve the above-mentioned problem, the series resonance circuit in the cold cathode tube lighting apparatus is additionally provided with a step-up transformer.

BEST MODE OF IMPLEMENTATION

The embodiments of the present invention will be explained with reference to the drawings.

First Embodiment

Figure 3:
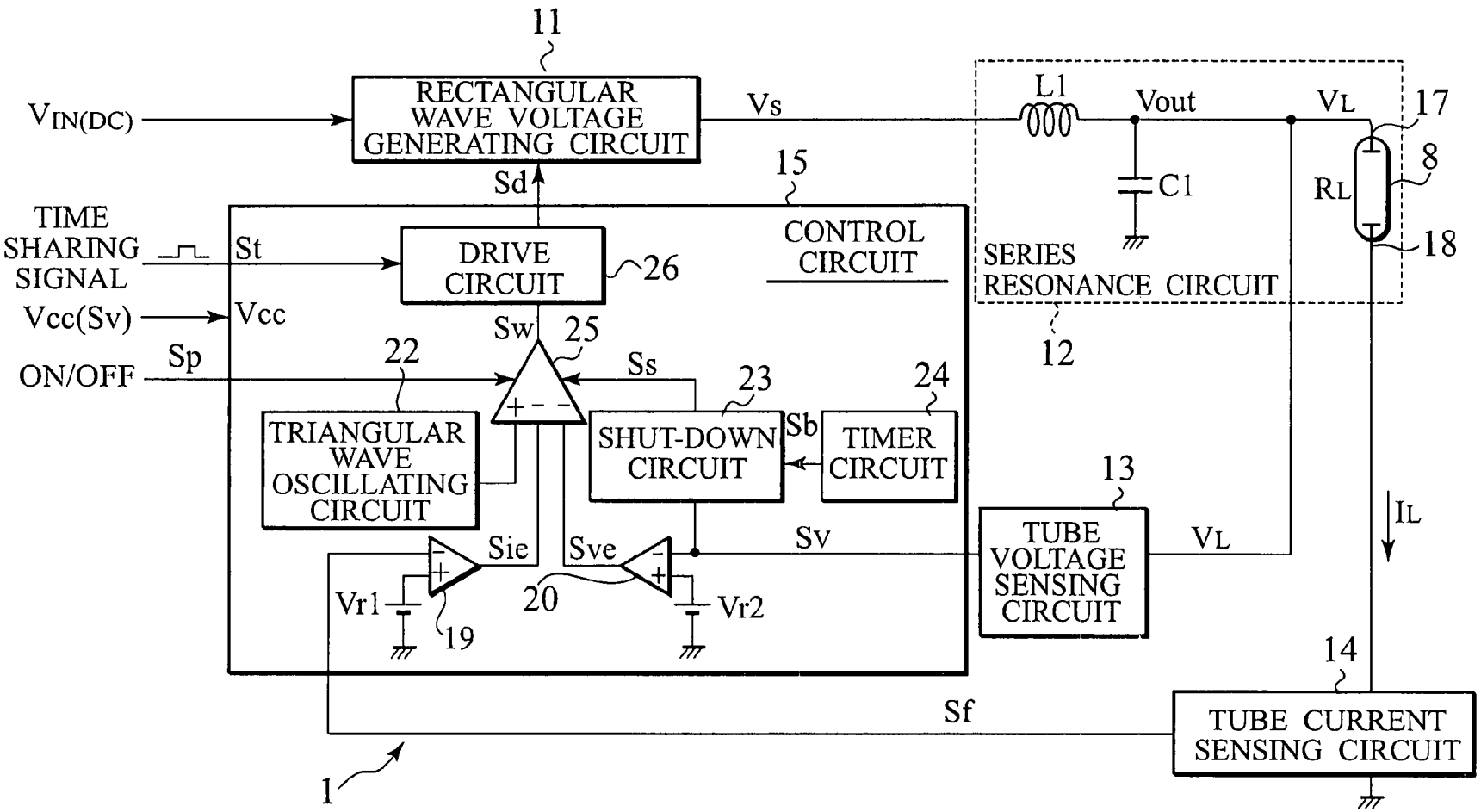
FIG. 3 is a view showing circuits in a cold cathode tube lighting apparatus 1 according to a first embodiment of the present invention.

FIG. 3 shows a cold cathode tube lighting apparatus 1 according to the first embodiment and a cold cathode tube 8 connected to the apparatus. The cold cathode tube lighting apparatus 1 consists of a rectangular wave voltage generating circuit 11, a series resonance circuit 12, a tube voltage sensing circuit 13, a tube current sensing circuit 14, and a control circuit 15.

The rectangular wave voltage generating circuit 11 is connected to or disconnected from a direct current input voltage $V_{IN(DC)}$ and outputs a positive-negative-symmetrical rectangular wave voltage Vs. The rectangular wave voltage Vs changes its pulse width in response to a drive signal Sd. The rectangular wave voltage generating circuit 11 may be of a known one, and therefore, no internal structure thereof will be shown or explained.

The series resonance circuit 12 consists of a resonance inductance L1, a first resonance capacitor C1, and the cold cathode tube 8. Among them, the resonance inductance L1 has an end connected to the rectangular wave voltage generating circuit 11, to receive the rectangular wave voltage Vs from the rectangular wave voltage generating circuit 11. The other end of the resonance inductance L1 is connected to an end of the first resonance capacitor C1. The other end of the first resonance capacitor C1 is earthed. A node between the resonance inductance L1 and the first resonance capacitor C1 is connected to a high-voltage terminal 17 of the cold cathode tube 8. A low-voltage terminal 18 thereof is earthed through the tube current sensing circuit 14.

Figure 14:
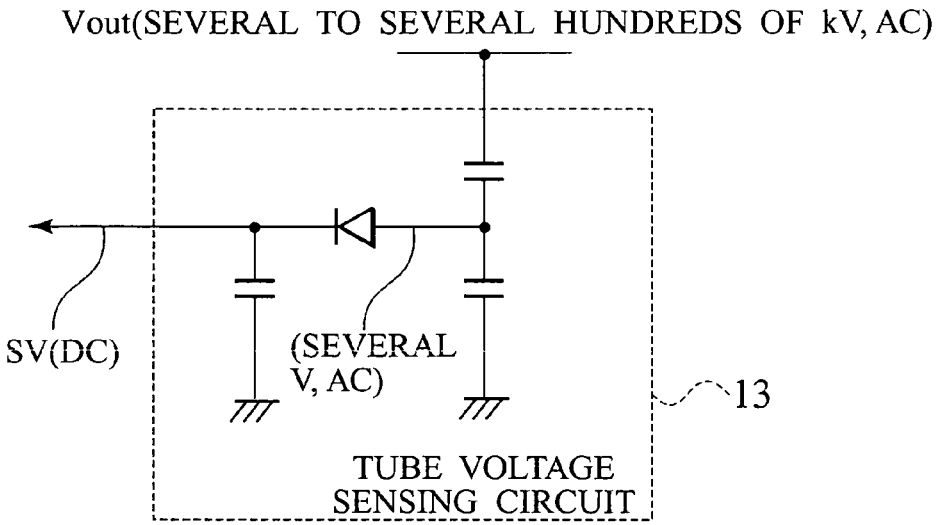
FIG. 14 is a view showing an example of a tube voltage sensing circuit 13.

The tube current sensing circuit 14 may also be a known one. For example, the tube current sensing circuit 14 of the conventional apparatus shown in FIG. 2 may be employed. The tube voltage sensing circuit 13 may also be a known one. An example thereof is shown in FIG. 14. An input terminal of the tube voltage sensing circuit 13 is connected to the high-voltage terminal 17 of the cold cathode tube 8. The tube voltage sensing circuit 13 detects a voltage at the node, i.e., a tube voltage $V_L$ of the cold cathode tube 8 and outputs a voltage detected signal Sv.

The control circuit 15 has error amplifiers 19 and 20, a triangular wave oscillating circuit 22, a shut-down circuit 23, a timer circuit 24, a PWM control circuit 25, a drive circuit 26, and the like. The control circuit 15 also has a regulator, a start circuit, and the like, which are not directly related to the operation of the present invention, and therefore, are not shown or explained. "PWM" is pulse width modulation. Among them, the error amplifier 19 amplifies a difference between a feedback signal Sf from the tube current sensing circuit 14 and a reference voltage Vr1 and outputs a current error signal Sie. The other error amplifier 20 amplifies a difference between the voltage detected signal Sv from the tube voltage sensing circuit 13 and a reference voltage Vr2 and outputs a voltage error signal Sve.

The current error signal Sie and voltage error signal Sve are supplied to inverting input terminals (−) of the PWM control circuit 25. A triangular wave from the triangular wave oscillating circuit 22 is supplied to an in-phase input terminal (+) of the PWM control circuit 25. According to the input signals, the PWM control circuit 25 outputs a pulse width signal Sw. At this time, a larger one of the current error signal Sie and voltage error signal Sve is selected. Namely, when an excessive voltage or current increases the error signal, the pulse width signal Sw is controlled to narrow the pulse width of the rectangular wave.

Figure 6:
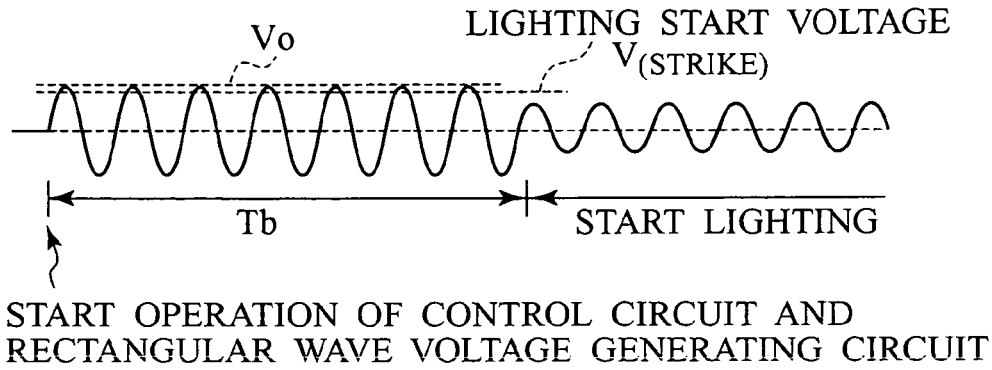
FIG. 6 is a graph showing an output voltage of the series resonance circuit when a cold cathode tube is black-started in the cold cathode tube lighting apparatus 1 according to the first embodiment of the present invention.
Figure 7:
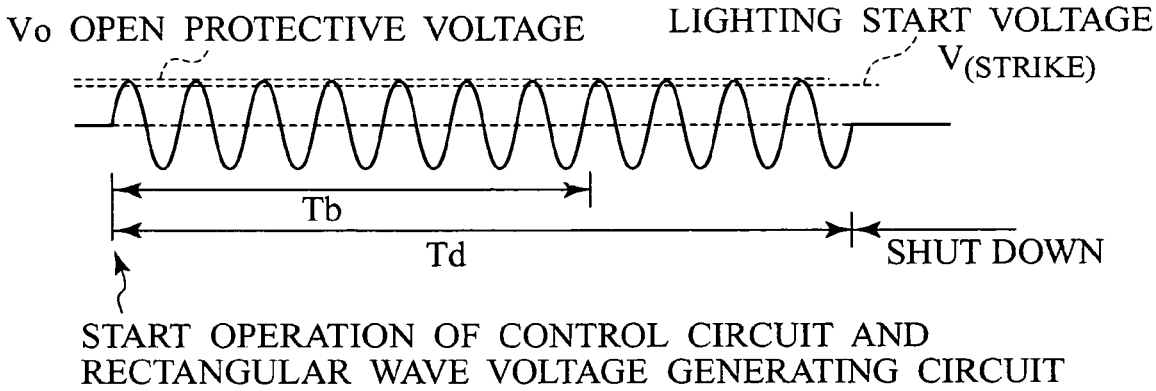
FIG. 7 is a graph showing an output voltage of the series resonance circuit when a cold cathode tube is detached in the cold cathode tube lighting apparatus 1 according to the first embodiment of the present invention.

In addition to them, the PWM control circuit 25 receives an ON/OFF signal Sp and a shut-down signal Ss. The ON/OFF signal Sp is a signal to turn on/off the cold cathode tube 8. It is set to a high level to turn on the cold cathode tube and a low level to turn off the same. Only when the signal Sp is at a high level, the pulse width signal Sw is provided. The shut-down signal Ss is provided by the shut-down circuit 23 to protect circuits when the tube voltage $V_L$ reaches an open protective voltage Vo (see FIGS. 6 and 7, a predetermined voltage set to be slightly higher than a lighting start voltage $V_{(STRIKE)}$). Upon receiving the shut-down signal Ss, the PWM control circuit 25 stops outputting the pulse width signal Sw. As shown in FIGS. 6 and 7, the open protective voltage Vo is a predetermined voltage set to be slightly higher than the lighting start voltage $V_{(STRIKE)}$.

The timer circuit 24 supplies an operation stop signal Sb to the shut-down circuit 23 during a delay period Td shown in FIG. 7. While the operation stop signal Sb is being supplied, the shut-down circuit 23 provides no shut-down signal Ss even if the tube voltage $V_L$ reaches the open protective voltage Vo.

The pulse width signal Sw from the PWM control circuit 25 is supplied to the drive circuit 26. While the pulse width signal Sw is being supplied, the drive circuit 26 supplies a drive signal Sd to switching elements (not shown) of the rectangular wave voltage generating circuit 11. According to the drive signal Sd, the rectangular wave voltage generating circuit 11 generates the rectangular wave voltage Vs, and if the drive signal Sd is stopped, stops generating the rectangular wave voltage Vs.

Figure 15:
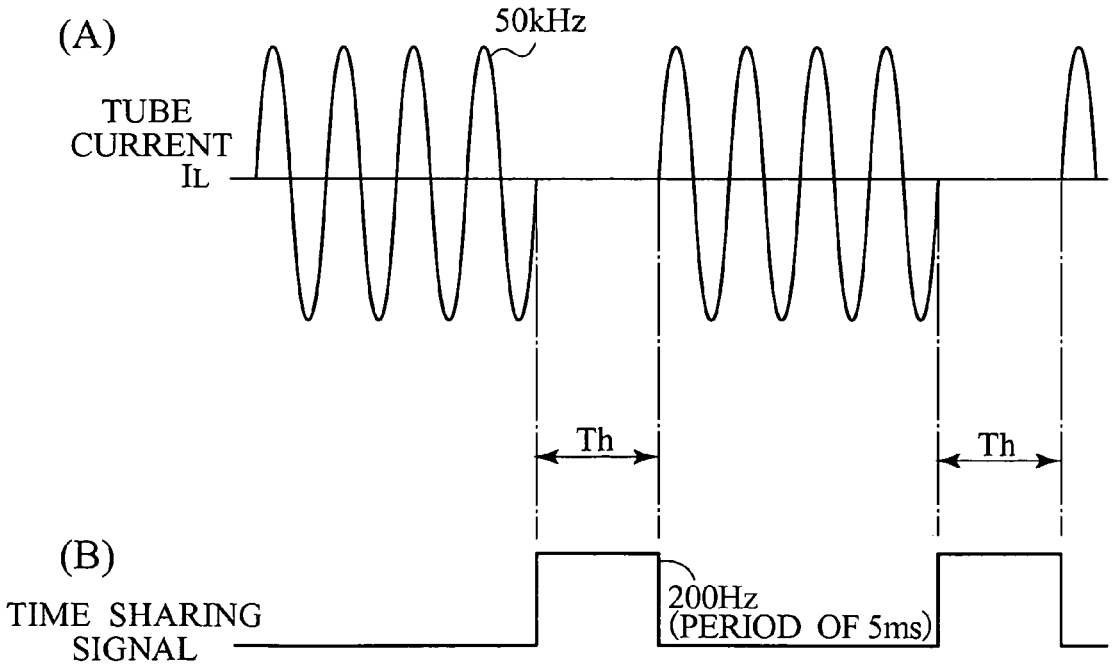
FIG. 15(A) is a view showing an example waveform of a tube current $I_L$ under time sharing control.
FIG. 15(B) is a view showing an example waveform of a time sharing signal St.

The drive circuit 26 also receives a time sharing signal St shown in FIG. 15(B). The time sharing signal St is to temporarily turn off the cold cathode tube 8 at predetermined intervals. During a high-level period Th of the time sharing signal St, the drive signal Sd is not provided. Accordingly, the tube current $I_L$ of the cold cathode tube 8 is pulse-modulated in response to the time sharing signal St as shown in FIG. 15(A). Namely, the tube current is intermittently driven. More precisely, the tube current $I_L$ has a frequency of, for example, 50 kHz and the time sharing signal St has a frequency of, for example, 200 Hz (a period of 5 ms). Human eyes are unable to recognize the intermittence of the cold cathode tube 8 operating at 200 Hz and recognize that the intensity of the cold cathode tube 8 is averaged and lowered. During the period Th in which the tube is turned off according to the time sharing signal St, no power is supplied, and therefore, there is no efficacy deterioration.

Operation of the cold cathode tube lighting apparatus according to this embodiment will be explained.

Initially, the rectangular wave voltage generating circuit 11 is in a standby state with the direct current input voltage $V_{IN(DC)}$ being supplied thereto. When a power source Vcc is supplied to the control circuit 15, the internal regulator and start circuit start to put the control circuit 15 in a standby state. When the ON/OFF signal Sp is set to a high level, the rectangular wave voltage generating circuit 11 starts to receive the drive signal Sd and output the rectangular wave voltage Vs.

When driven around the resonance frequency of the series resonance circuit 12, the rectangular wave voltage Vs is shaped by the series resonance circuit 12 substantially into a sinusoidal waveform, which is applied to the high-voltage terminal 17 of the cold cathode tube 8. At this time, the control circuit 15 controls the duty of the rectangular wave voltage Vs, and therefore, the output voltage of the series resonance circuit 12 is kept at the open protective voltage Vo (FIG. 6). When black start is conducted, the cold cathode tube 8 is turned on after a black start period Th of 0.5 to 2 seconds (FIG. 6). When normal start is conducted, the cold cathode tube 8 is turned on more quickly.

Once the cold cathode tube 8 is lit, the tube current $I_L$ thereof is detected by the tube current sensing circuit 14. To maintain the tube current $I_L$ at a predetermined value, the control circuit 15 controls the duty of the rectangular wave voltage Vs. In addition, the tube voltage $V_L$ is detected by the tube voltage sensing circuit 13. If the tube voltage $V_L$ exceeds the open protective voltage Vo due to some reason, the control circuit 15 controls the duty of the rectangular wave voltage Vs in such a way as to narrow the pulse width of the rectangular wave voltage Vs.

If the cold cathode tube 8 is detached, the rectangular wave voltage Vs is stopped after the delay period Td (FIG. 7). Accordingly, there is no risk of badly affecting peripheral devices.

Figure 4:
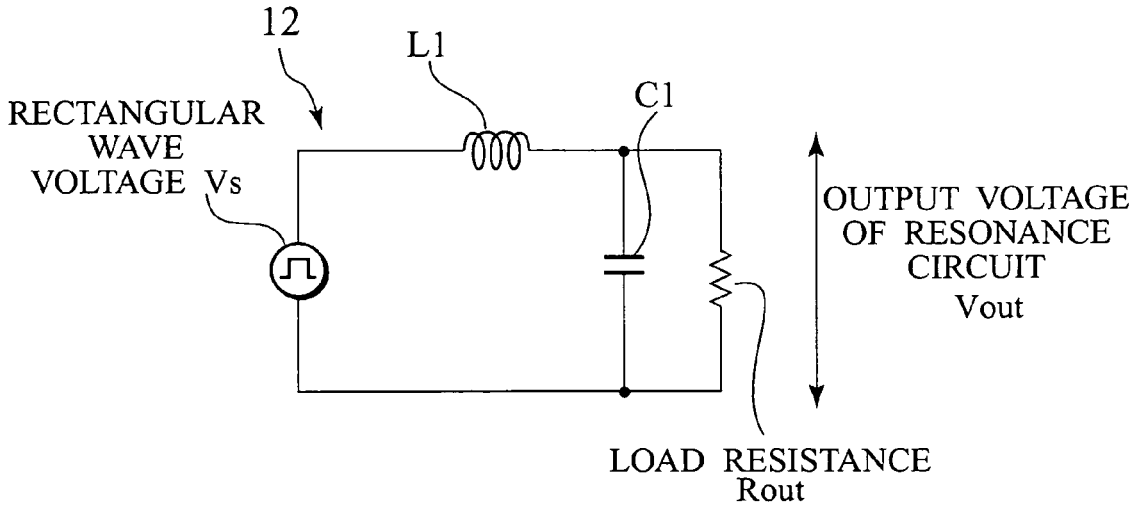
FIG. 4 is a view showing a series resonance circuit picked up from FIG. 3.
Figure 5:
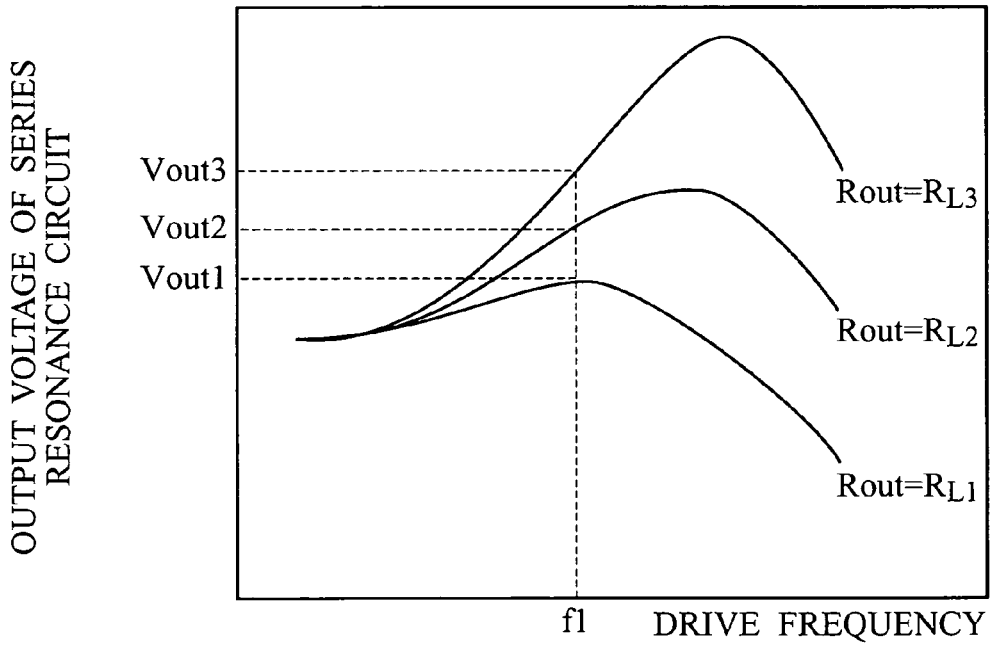
FIG. 5 is a graph showing an output voltage characteristic of the series resonance circuit 12 shown in FIG. 4.

Advantages in driving the cold cathode tube 8 with the series resonance circuit 12 will further be explained. FIG. 4 shows the series resonance circuit 12 picked up from the circuits shown in FIG. 3. An output voltage Vout of this circuit varies depending on load resistance Rout. As shown in FIG. 5, it generates a higher voltage as the load resistance Rout is increased. In FIG. 5, $R_{L1}$ to $R_{L3}$ represent impedance values of the cold cathode tube 8 and have a relationship of $R_{L3}>R_{L2}>R_{L1}$.

If stable discharge is maintained in a load range where the cold cathode tube 8 demonstrates a negative resistance characteristic, the tube voltage $V_L$ and tube impedance $R_L$ of the cold cathode tube 8 increase if the tube current $I_L$ of the cold cathode tube 8 decreases.

In this case, the load resistance Rout shown in FIG. 3 corresponds to the tube impedance $R_L$. Increasing the tube impedance $R_L$ corresponds to increasing the load resistance value Rout of the series resonance circuit 12 shown in FIG. 3. As a result, the output voltage Vout of the series resonance circuit 12 also increases as mentioned above.

This characteristic well matches with the characteristic of the cold cathode tube 8 that the impedance $R_L$ increases as the tube current $I_L$ decreases. If the tube current $I_L$ decreases to increase the impedance $R_L$, a higher voltage is needed to maintain a lit state. In this case, the output voltage Vout of the series resonance circuit 12 increases in response to the increase in the impedance $R_L$, to supply the voltage necessary for keeping the lit state of the cold cathode tube 8. Namely, employing the series resonance circuit realizes a circuit structure matching with the impedance characteristic of the cold cathode tube 8.

Figure 1:
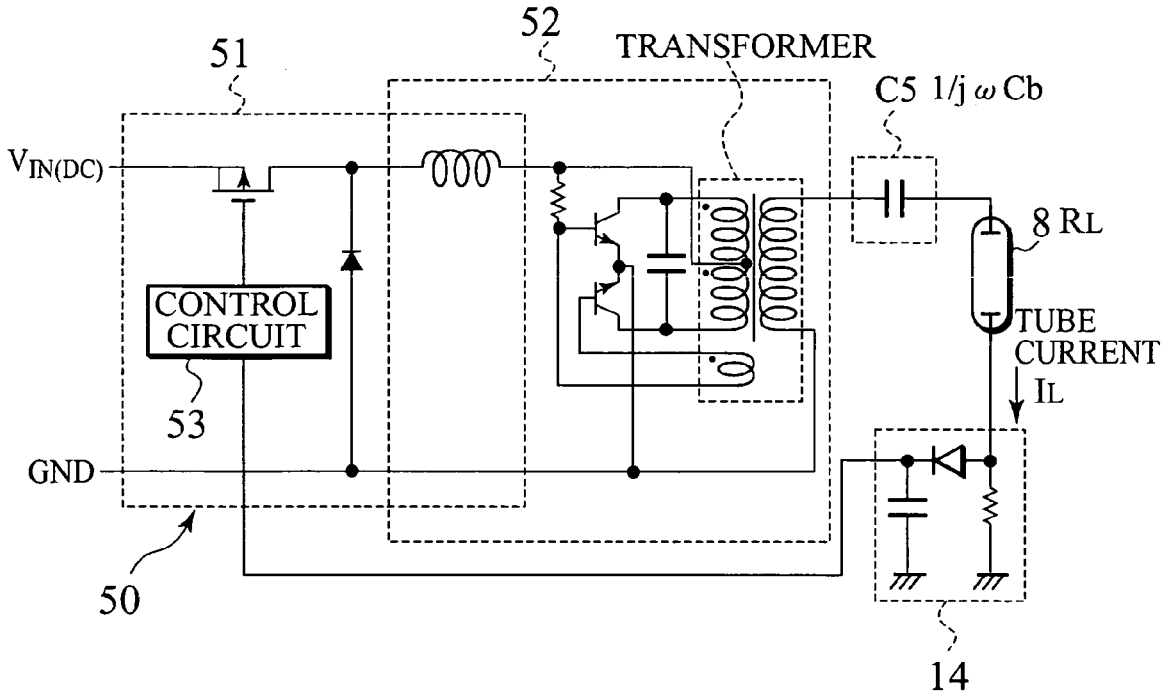
FIG. 1 PRIOR ART
FIG. 1 is a view showing circuits in an example 50 of a conventional cold cathode tube lighting apparatus.

With respect to a predetermined tube current value, the maximum output voltage of the series resonance circuit 12 must be greater than the tube voltage $V_L$ to maintain discharge. Otherwise, no stabilized lit state is maintained even if a feedback circuit and the like are employed for stabilization. Then, like the conventional lighting apparatus 50 of FIG. 1, a pulsating current, intermittent oscillation, or flicker-off will occur.

To avoid this, the present invention sets a constant of the series resonance circuit 12 so that the maximum output voltage of the series resonance circuit 12 with respect to a predetermined tube current value exceeds the tube voltage $V_L$ of the cold cathode tube 8 at the time of lighting the cold cathode tube and in an operating load range of the cold cathode tube of negative resistance characteristic.

Figure 2:
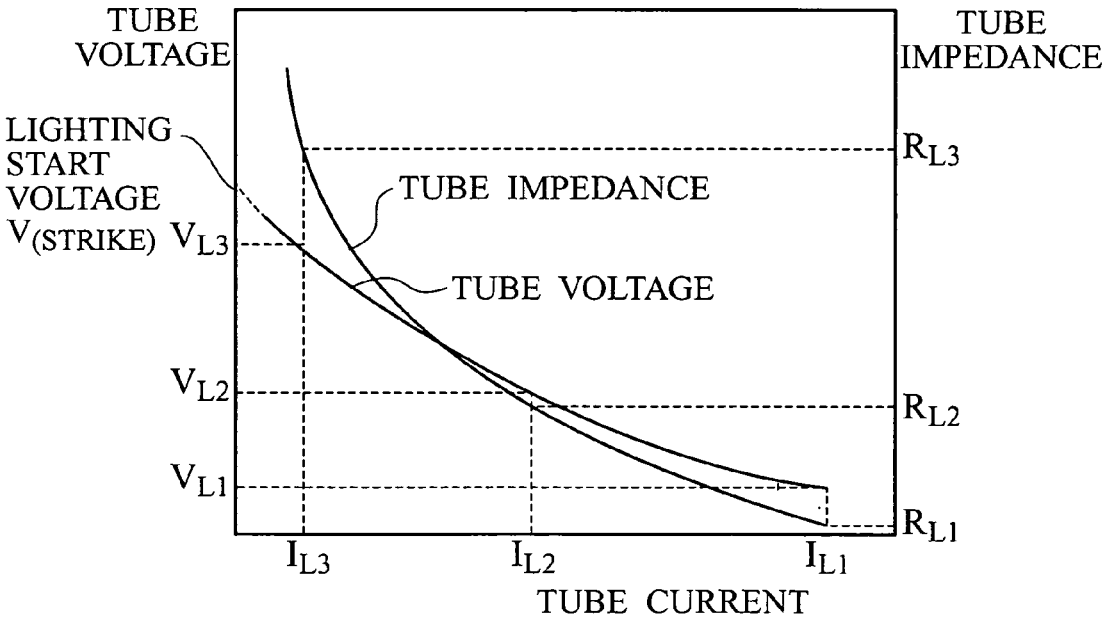
FIG. 2 is a graph showing a tube current-tube voltage characteristic and a tube current-tube impedance characteristic of a cold cathode tube.

An example of this will be explained with reference to FIGS. 2 and 5. It is assumed that the rectangular wave voltage Vs has a constant drive frequency of fl. If the tube current is $I_{L1}$, the cold cathode tube 8 needs a voltage $V_{L1}$ to stably maintain discharge with the load current. At this time, the load of the series resonance circuit 12 is an impedance Rout equivalent to a cold cathode tube impedance $R_{L1}$ at this time. An output voltage Vout1 of the series resonance circuit $I_{L2}$ is set to satisfy Vout1$\geqq V_{L1}$. Similarly, it is set to satisfy Vout2$\geqq V_{L2}$ with a tube current of $I_{L2}$ and to satisfy Vout3$\geqq V_{L3}$ with a tube current of $I_{L3}$.

If the maximum output voltage of the series resonance circuit 12 with respect to a predetermined tube current value is greater than the tube voltage $V_L$ of the cold cathode tube 8, the lighting state of the cold cathode tube 8 is stabilized. Accordingly, the tube current sensing circuit 14 and control circuit 15 are used to control the pulse width of the rectangular wave voltage Vs, thereby adjusting a power supply quantity from the rectangular wave voltage generating circuit 11 and obtaining a required tube voltage $V_L$ and tube current $I_L$.

The series resonance circuit however, generates a high voltage when no load is present. Accordingly, if the cold cathode tube 8 is detached, peripheral devices will badly be affected and the reliability of the lighting apparatus itself will deteriorate.

On the other hand, the cold cathode tube lighting apparatus 1 must continuously provide the lighting start voltage $V_{(STRIKE)}$ until the cold cathode tube 8 is turned on in black start of the cold cathode tube 8.

To solve these problems, the tube voltage $V_L$ is prevented from exceeding the open protective voltage Vo until the cold cathode tube 8 is lit at black start of the cold cathode tube 8 as shown in FIG. 6. This prevents an unnecessary high voltage and supplies a sufficient voltage to stably turn on the cold cathode tube at black start.

When the cold cathode tube 8 is detached, the tube voltage $V_L$ is prevented from exceeding the open protective voltage Vo, and the operation of the rectangular wave voltage generating circuit 11 is stopped after the delay period Td to provide protection for the tube detached state, as shown in FIG. 7. More precisely, as explained above, the timer circuit 24 stops the operation of the shutdown circuit 23 during the delay period Td, to thereby continuously apply a voltage to the cold cathode tube 8. If there is an overvoltage after the delay period Td (no lighting), the shut-down circuits 23 operates to stop applying the voltage. The delay period Td is a period set to be slightly longer than the black start period Th of the cold cathode tube 8. The black start period Th is about 0.5 to 2 seconds, and therefore, the delay period Td is set to be slightly longer than that, for example, 2.5 seconds.

Second Embodiment

Figure 8:
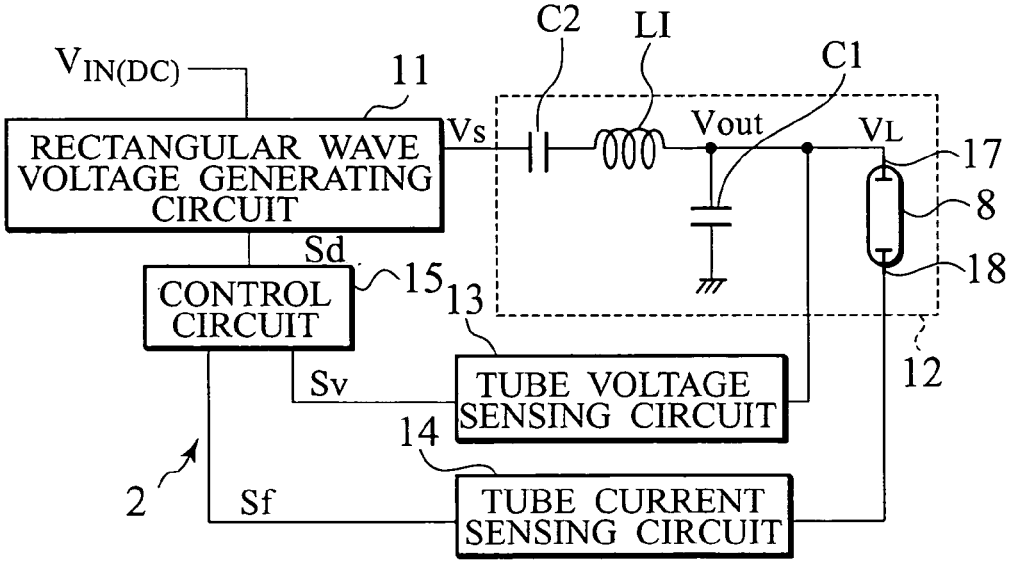
FIG. 8 is a view showing a cold cathode tube lighting apparatus 2 according to a second embodiment of the present invention.

FIG. 8 shows a cold cathode tube lighting apparatus 2 according to the second embodiment.

This cold cathode tube lighting apparatus 2 inserts a second resonance capacitor C2 between a rectangular wave voltage generating circuit 11 and a resonance inductance L1. This is different from the cold cathode tube lighting apparatus 1 of the first embodiment. Inserting the second resonance capacitor C2 results in stably maintaining a lit state with a lower input voltage $V_{IN(DC)}$ in a range where the tube impedance of a cold cathode tube is low.

Third Embodiment

Figure 9:
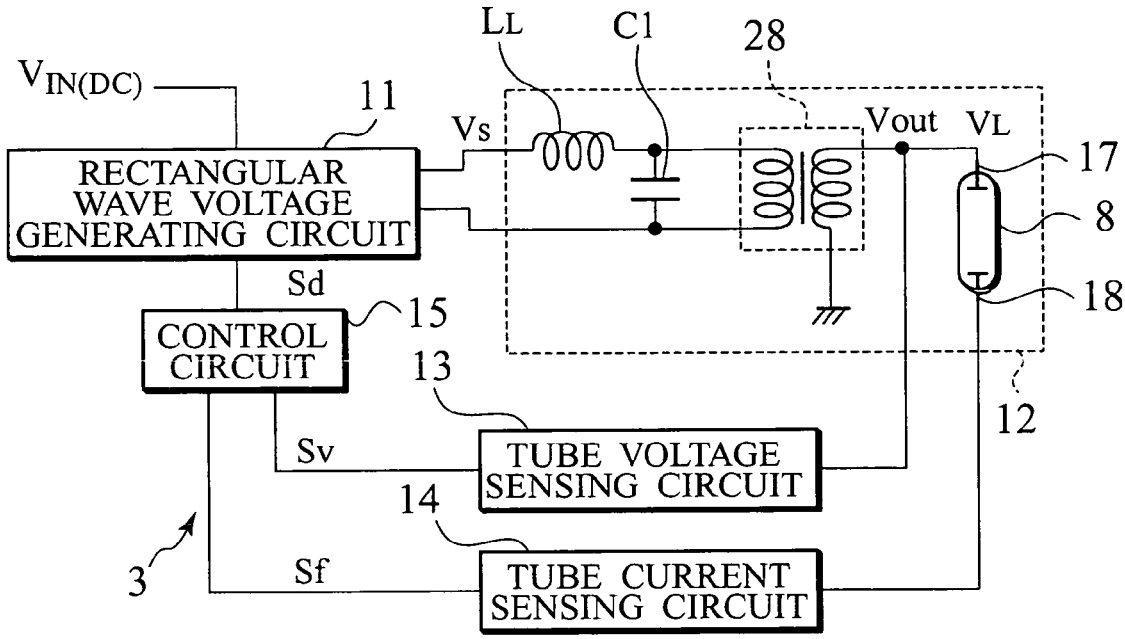
FIG. 9 is a view showing a cold cathode tube lighting apparatus 3 according to a third embodiment of the present invention.

FIG. 9 shows a cold cathode tube lighting apparatus 3 according to the third embodiment.

This embodiment arranges a step-up transformer 28 between a first resonance capacitor C1 and a cold cathode tube 8. This results in stably maintaining a lit state even with a further reduced input voltage $V_{IN(DC)}$.

Fourth Embodiment

Figure 10:
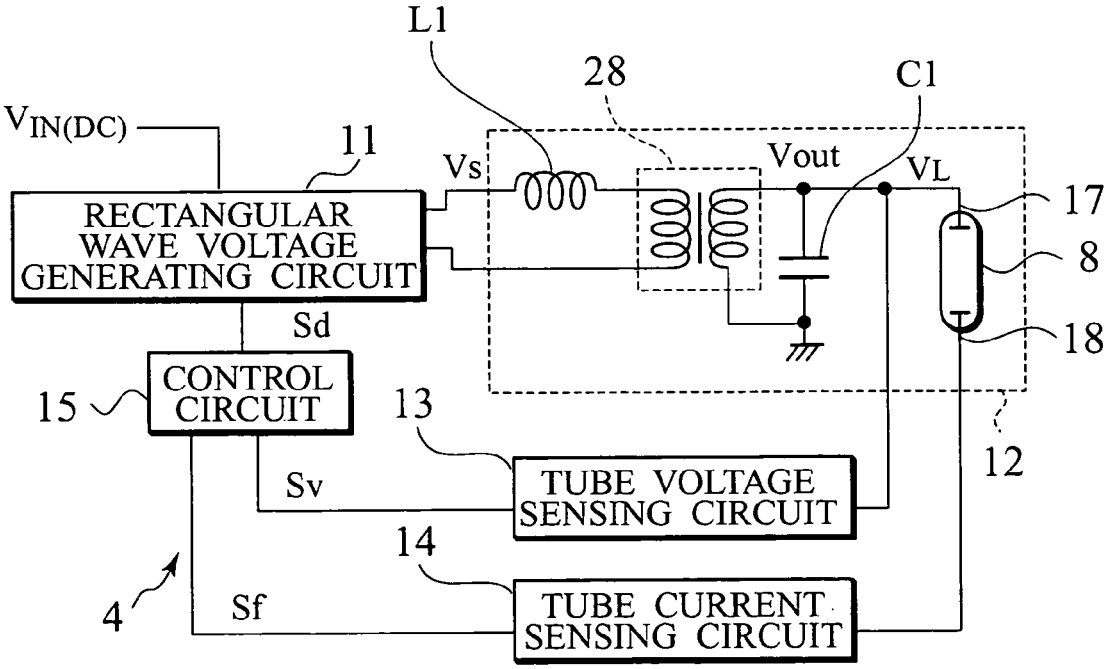
FIG. 10 is a view showing a cold cathode tube lighting apparatus 4 according to a fourth embodiment of the present invention.

FIG. 10 shows a cold cathode tube lighting apparatus 4 according to the fourth embodiment.

This embodiment arranges a step-up transformer 28 after a resonance inductance L1, and after the step-up transformer, a first resonance capacitor C1. This arrangement can also maintain a stable lit state with a lower input voltage $V_{IN(DC)}$.

Fifth Embodiment

Figure 11:
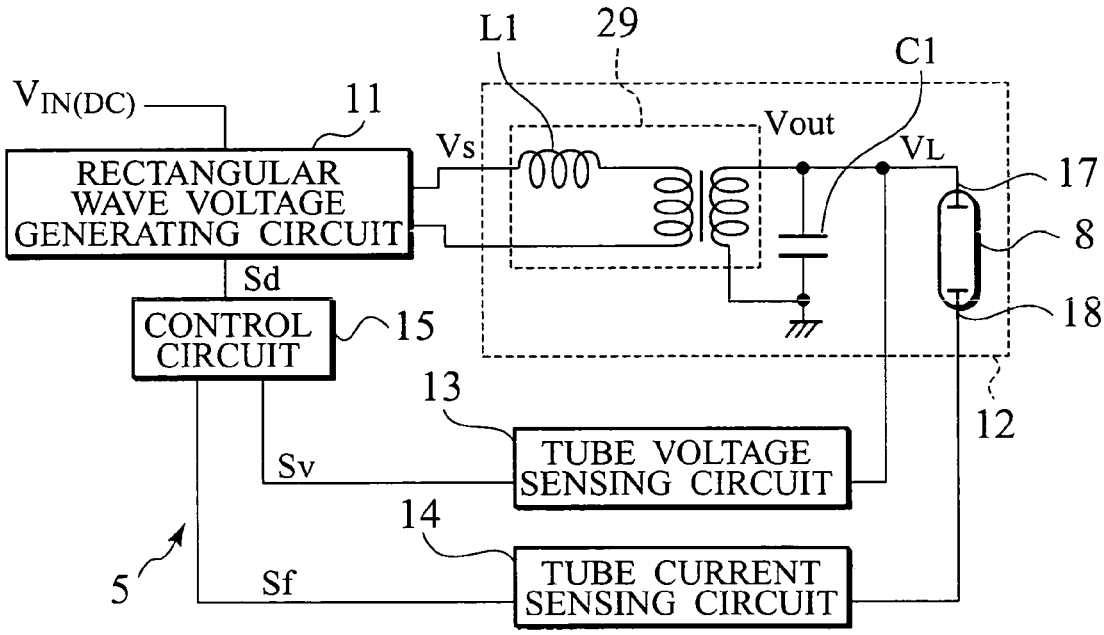
FIG. 11 is a view showing a cold cathode tube lighting apparatus 5 according to a fifth embodiment of the present invention.

FIG. 11 shows a cold cathode tube lighting apparatus 5 according to the fifth embodiment.

This embodiment arranges a first resonance capacitor C1 after a leakage transformer 29. A leakage inductance LL of the leakage transformer 29 is used as a resonance inductance of a series resonance circuit. Due to this, there is no need of preparing the separate resonance inductance L1 of the first embodiment. This results in reducing the number of parts, cost, and parts space.

Sixth Embodiment

Figure 12:
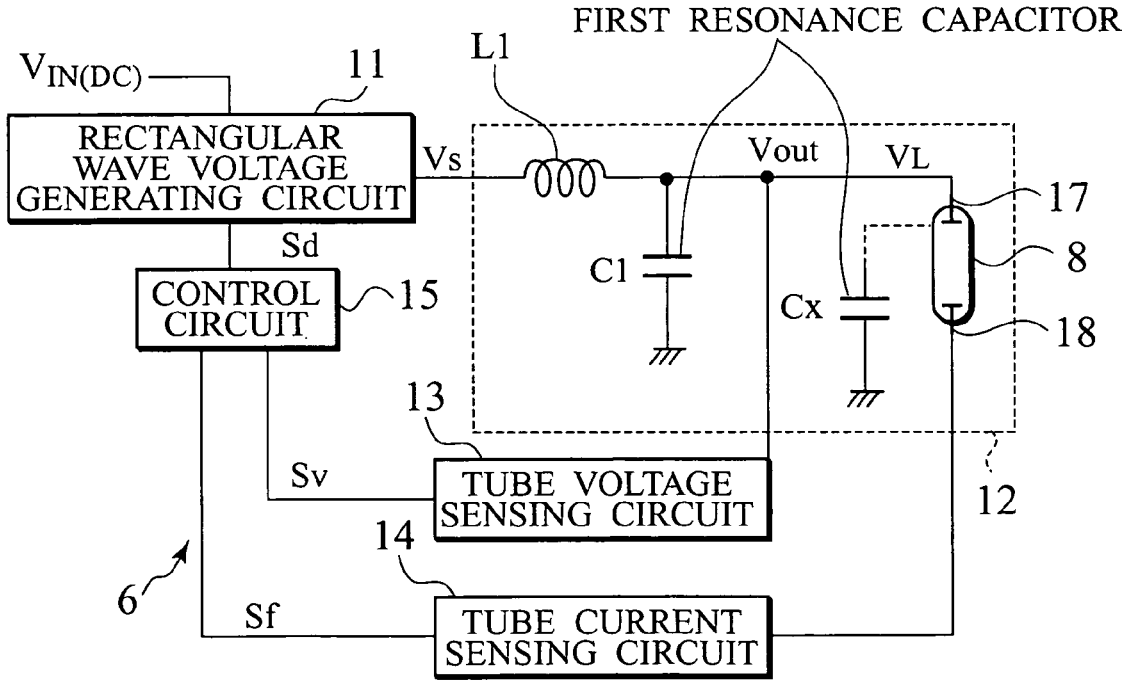
FIG. 12 is a view showing a cold cathode tube lighting apparatus 6 according to a sixth embodiment of the present invention.

FIG. 12 shows a cold cathode tube lighting apparatus 6 according to the sixth embodiment.

A display panel of, for example, a notebook personal computer is provided with a reflection panel around a cold cathode tube 8. The reflection panel is usually earthed, to form a parasitic capacitor Cx. FIG. 14 additionally considers this parasitic capacitor Cx as capacitance of a resonance capacitor. This results in more correctly setting a constant. Additionally considering a parasitic capacitor of a wiring board will further improve the correctness of computation.

Seventh Embodiment

Figure 13:
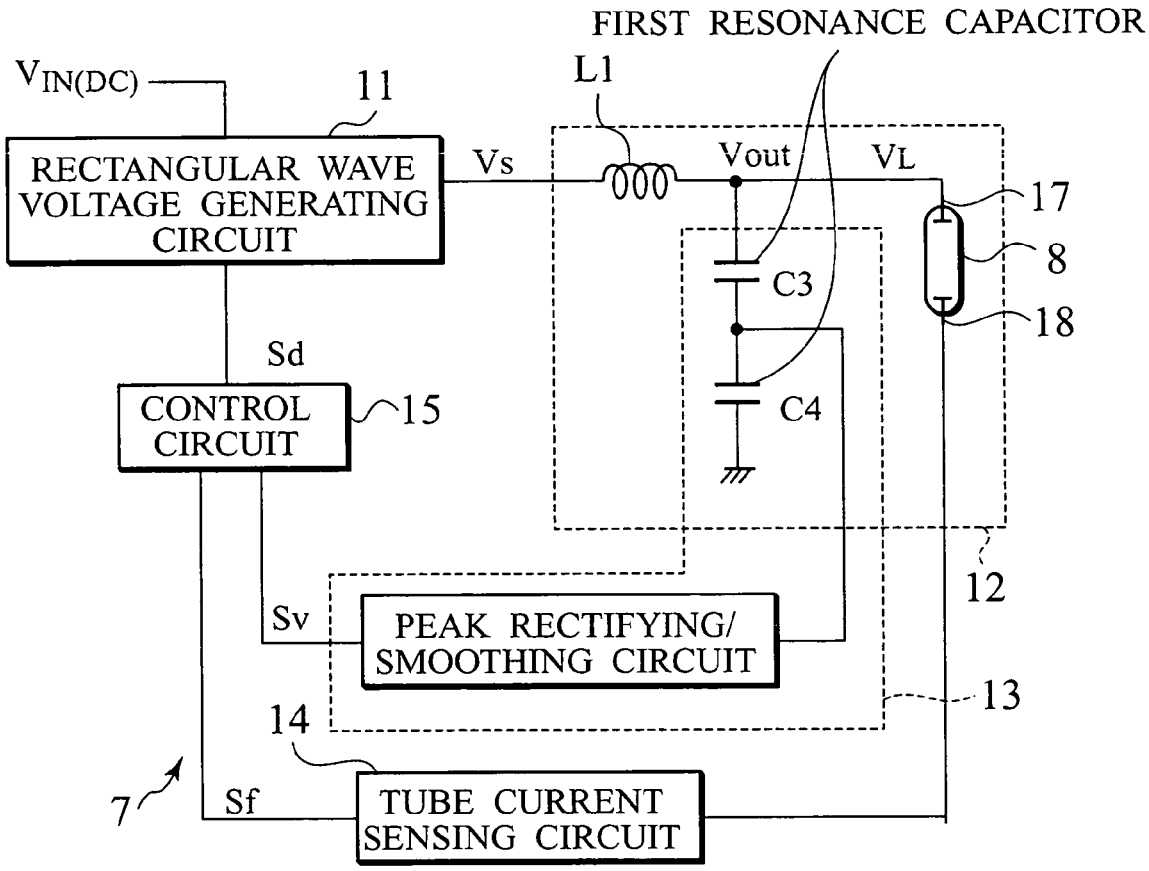
FIG. 13 is a view showing a cold cathode tube lighting apparatus 7 according to a seventh embodiment of the present invention.

FIG. 13 shows a cold cathode tube lighting apparatus 7 according to the seventh embodiment.

This embodiment forms a first resonance capacitor from two capacitors C3 and C4. These two capacitors C3 and C4 are also used as voltage dividing capacitors of a tube voltage sensing circuit 13. This embodiment, therefore, reduces the number of parts, cost, and parts space.

The embodiments control each the pulse width of the rectangular wave voltage Vs. The present invention is not limited to such control. For example, the present invention can control the frequency (period) of the rectangular wave voltage Vs. In this case, a resonance circuit constant is set such that the drive frequency of the rectangular wave voltage Vs is always higher than the resonance frequency of the series resonance circuit 12. Then, an increase in the frequency of the rectangular wave voltage Vs lowers the output voltage Vout of the series resonance circuit, and a decrease in the frequency of the rectangular wave voltage Vs provides an opposite result The present invention can control both the pulse width and frequency of the rectangular wave voltage Vs.

According to the first technical aspect of the present invention, a rectangular wave voltage is supplied to the series resonance circuit whose output drives a cold cathode tube. The series resonance circuit has a constant that is set to make a maximum output voltage with respect to a given tube current value higher than a tube voltage of the cold cathode tube at the start of lighting the cold cathode tube and in an operating load range of the cold cathode tube of negative resistance characteristic. While the cold cathode tube is being lit, the control circuit controls a cold cathode tube current to a predetermined value, and at black start of the cold cathode tube, controls a tube voltage to be higher than a predetermined voltage until the cold cathode tube is turned on.

As a result, no pulsating current, intermittent oscillation, or flicker-off occurs even under low load, and the cold cathode tube is stably lit and is maintained at the lit state. In addition, the lighting of the cold cathode tube is safely started.

According to the second technical aspect of the present invention, the control circuit further prevents, if the cold cathode tube is detached, a cold cathode tube voltage from exceeding a predetermined voltage and stops the operation of the rectangular wave generating circuit after a predetermined time.

As a result, there will be no risk of badly affecting peripheral devices even if the cold cathode tube is detached.

According to the third technical aspect of the present invention, the series resonance circuit is additionally provided with a step-up transformer to step up an output voltage.

This results in stably turning on the cold cathode tube and maintaining a lit state thereof even with a low source voltage.

According to the fourth technical aspect of the present invention, a second resonance capacitor is arranged before a resonance inductance, to stably maintain a lit state with a lower input voltage $V_{IN(DC)}$ in particular in a range where the tube impedance of the cold cathode tube is low.

According to the fifth technical aspect of the present invention, the control circuit operates like the control circuit of claim 2 when the cold cathode tube is detached.

As a result, a lit state is stably maintained with a lower input voltage $V_{IN(DC)}$ in a range where the tube impedance of the cold cathode tube is low.

According to the sixth technical aspect of the present invention, an output voltage is increased in the cold cathode tube lighting apparatus of any one of claims 4 and 5, like the invention of claim 3.

This results in achieving the same effect as the invention of claim 3. In addition, a lit state is stably maintained with a lower input voltage $V_{IN(DC)}$ in a range where the tube impedance of the cold cathode tube is low.

What is claimed is:

1. A cold cathode tube lighting apparatus comprising:

a rectangular wave voltage generating circuit to generate a positive-negative-symmetrical rectangular wave voltage from a direct current input voltage;

a series resonance circuit having a resonance inductance connected in series with a parallel connection of a first resonance capacitor and a cold cathode tube, to convert the rectangular wave voltage into a sinusoidal wave voltage, a constant of the series resonance circuit being set to make a maximum output voltage for a predetermined cold cathode tube current value exceed a tube voltage of the cold cathode tube at the start of lighting the cold cathode tube and in an operating load range of the cold cathode tube of negative resistance characteristic;

a cold cathode tube voltage sensing circuit to detect a tube voltage of the cold cathode tube and output a voltage detected signal;

a cold cathode tube current sensing circuit to detect a tube current of the cold cathode tube and output a current detected signal; and a control circuit controlling the duty of the rectangular wave voltage, the control circuit including:

a timer circuit outputting an operation stop signal during a delay period that is longer than a black start period;

a shut-down circuit outputting a shut-down signal in a case where the voltage detected signal is above a predetermined voltage when the timer circuit is not supplying the operation stop signal;

a first error amplifier amplifying a difference between the current detected signal and a first reference voltage and outputting a current error signal;

a second error amplifier amplifying a difference between the voltage detected signal and a second reference voltage and outputting a voltage error signal;

a triangular wave oscillating circuit generating a triangular wave signal;

a PWM control circuit comparing the current error signal and voltage error signal with the triangular wave signal and outputting a pulse width signal when the shut-down circuit is not supplying the shut-down signal; and a drive circuit outputting a drive signal while the PWM control circuit is supplying the pulse width signal, wherein the drive signal being outputted to the rectangular wave voltage generating circuit while the cold cathode tube is in a lit state so that a cold cathode tube current has a predetermined current according to the current detected signal from the cold cathode tube current sensing circuit, the drive signal being outputted to the rectangular wave voltage generating circuit until the cold cathode tube is lit at the time of black start of the cold cathode tube so that a tube voltage of the cold cathode tube is set to be greater than a lighting start voltage and smaller than an open protective voltage according to the voltage detected signal from the cold cathode tube voltage sensing circuit, and the drive signal being output to the rectangular wave voltage generating circuit when the cold cathode tube is detached so that a tube voltage of the cold cathode tube is set to be greater than the lighting start voltage and lower than the open protective voltage according to the voltage detected signal from the cold cathode tube voltage sensing circuit, and the drive signal to the rectangular wave voltage generating circuit being stopped after the delay period.

2. The cold cathode tube lighting apparatus of claim 1, wherein the series resonance circuit further includes a second resonance capacitor connected in series with the resonance inductance.

3. The cold cathode tube lighting apparatus of claim 1 or 2, wherein the series resonance circuit further includes a step-up transformer connected between the first resonance capacitor and the cold cathode tube.

4. The cold cathode tube lighting apparatus of claim 1 or 2, wherein the series resonance circuit further includes a step-up transformer connected between the resonance inductance and the first capacitor.

5. The cold cathode tube lighting apparatus of claim 4, wherein the step-up transformer is a leakage transformer and the resonance inductance is a leakage inductance of the leakage transformer.

6. The cold cathode tube lighting apparatus according to claim 1, wherein the first resonance capacitor includes a parasitic capacitor around the cold cathode tube.

7. The cold cathode tube lighting apparatus according to claim 1, wherein the first resonance capacitor is a voltage dividing capacitor of the tube voltage sensing circuit.

* * * * *